United States Patent [19]

Kötting et al.

[11] Patent Number: 4,637,168

[45] Date of Patent: Jan. 20, 1987

[54] SPECTACLE LENS EDGE GRINDING MACHINE

[75] Inventors: Fritz Kötting, Dormagen; Günther Barwasser, Neuss, both of Fed. Rep. of Germany

[73] Assignee: Wernicke & Co. GmbH, Düsseldorf-Eller, Fed. Rep. of Germany

[21] Appl. No.: 736,801

[22] Filed: May 22, 1985

Related U.S. Application Data

[63] Continuation-in-part of Ser. No. 502,098, Jun. 8, 1983, abandoned.

[30] Foreign Application Priority Data

Jun. 9, 1982 [DE] Fed. Rep. of Germany ..... 3221713

[51] Int. Cl.[4] ..... B24B 17/02

[52] U.S. Cl. ..... 51/50 PC; 51/101 LG; 51/165.79

[58] Field of Search ..... 51/34 R, 34 A, 34 C, 51/35, 50 PC, 92 R, 93, 95 R, 97 NC, 101 R, 101 LG, 165.77, 165.78, 165.79, 165.9, 165.92; 173/146, 147

[56] References Cited

U.S. PATENT DOCUMENTS

| | | | |
|---|---|---|---|
| 1,395,163 | 10/1921 | Tatosian | 51/95 R |
| 2,297,827 | 10/1942 | Ellenbecker | 51/34 A X |
| 3,736,704 | 6/1973 | Robillard et al. | 51/165.78 |
| 3,803,772 | 4/1974 | Klar | 51/165.79 X |
| 3,824,741 | 7/1974 | Wilson | 51/50 PC |
| 3,864,878 | 2/1975 | Ledebur et al. | 51/50 PC |
| 4,014,142 | 3/1977 | Coes | 51/165.92 X |
| 4,075,792 | 2/1978 | Schreiber | 51/165.92 |
| 4,176,498 | 12/1979 | Vulich et al. | 51/101 LG |
| 4,191,263 | 3/1980 | Malterer | 173/147 X |

FOREIGN PATENT DOCUMENTS

| | | | |
|---|---|---|---|
| 3221713 | 12/1983 | Fed. Rep. of Germany | 51/101 LG |

*Primary Examiner*—Robert P. Olszewski

*Attorney, Agent, or Firm*—Becker & Becker, Inc.

[57] ABSTRACT

A spectacle lens edge grinding machine either having a support which carries the template abutment and the grinding wheel, and which can be moved toward the fixedly mounted support shaft for the spectacle lens and the template, or a support which carries the support shaft for the spectacle lens and the template, and which can be moved toward the fixedly mounted template abutment and grinding wheel. In the first case, in the direction of movement of the support, a spring element which brings the support into its starting position acts on the support on that side remote from the support shaft for the spectacle lens and the template, and a tensioning device, which can be actuated and the tensioning force of which can be regulated, acts on the support on that side which faces the support shaft for the spectacle lens and the template. In the second case, in the direction of movement of the support, a spring element, which brings the support into its starting position, acts on the support on that side remote from the template abutment and the grinding wheel, and a tensioning device, which can be actuated and the tensioning force of which can be regulated, acts on the support on that side facing the template abutment and the grinding wheel.

14 Claims, 6 Drawing Figures n
12b
L m
12a

MS
K
S
1
2
3
3a
4
5
6
7
8
8a
9
10
11
11a
12
13
14
15
16
17
18
19
20
21
22
23
26
27
28
29
30

12
R
24
R1
R2
R3

MB
101
113a
123
123
103
112
113
105
111
104
114
115
116

SPECTACLE LENS EDGE GRINDING MACHINE

CROSS-REFERENCE TO RELATED APPLICATION

This is a continuation-in-part of co-pending U.S. patent application Ser. No. 502,098-Kötting et al filed June 8, 1983, now abandoned.

BACKGROUND OF THE INVENTION

1. Field of the Invention

The present invention relates to a spectacle lens edge grinding machine having a support which carries the template abutment and the grinding wheel, and which can be moved toward the fixedly mounted support shaft which carries the spectacle lens and the template. The present invention also relates to a spectacle lens edge grinding machine having a support which carries the support shaft for the spectacle lens and the template, and which can be moved toward the fixedly mounted template abutment and grinding wheel.

2. Description of the Prior Art

Spectacle lens edge grinding machines of this general type are known. With such machines, the grinding pressure of the grinding wheel on the periphery of the spectacle lens, or the pressure of spectacle lens on the fixedly mounted grinding wheel, is applied by gravitation or spring force. With known spectacle lens edge grinding machines where the upper part which supports the lens and the template is pivotable about a horizontal axis, the grinding pressure is produced by the weight of this upper part, with this grinding pressure being variable by mounting on the upper part either an adjustable spring or a weight, the length of which is adjustable.

It is an object of the present invention to improve these known spectacle lens edge grinding machines in such a way that the grinding pressure, i.e. the pressure of the spectacle lens against the grinding wheel, or vice versa, can be adjusted over a wide range, and that this adjustment is effected automatically during the grinding itself as a function of the thickness of the lens at that peripheral section of the lens which is being machined. Furthermore, removal of the lens from the grinding wheel, or the grinding wheel from the lens, should be capable of being effected momentarily, and all of this should be capable of being achieved with means which are structurally simple, and which can be operated and serviced easily.

BRIEF DESCRIPTION OF THE DRAWINGS

These objects, and other objects and advantages of the present invention, will appear more clearly from the following specification in conjunction with the accompanying drawings, in which.

Figures 1, 2A, 2B:
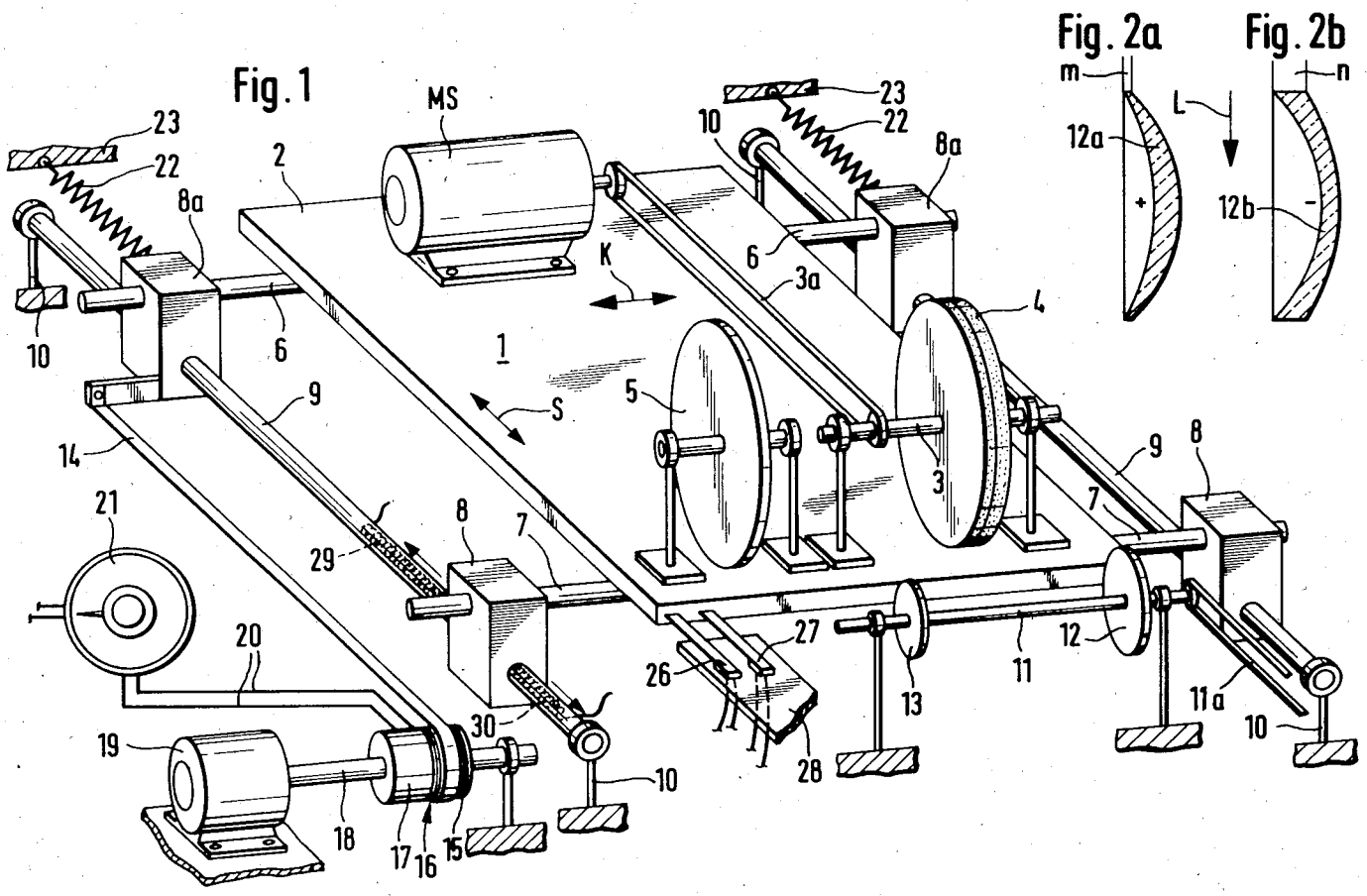
FIG. 1 illustrates one embodiment of the inventive spectacle lens edge grinding machine, and in particular shows the carriage which is movable in two directions and carries the grinding wheel and the template abutment, and also shows the fixedly mounted spectacle lens and the template.
Figures 3, 4:
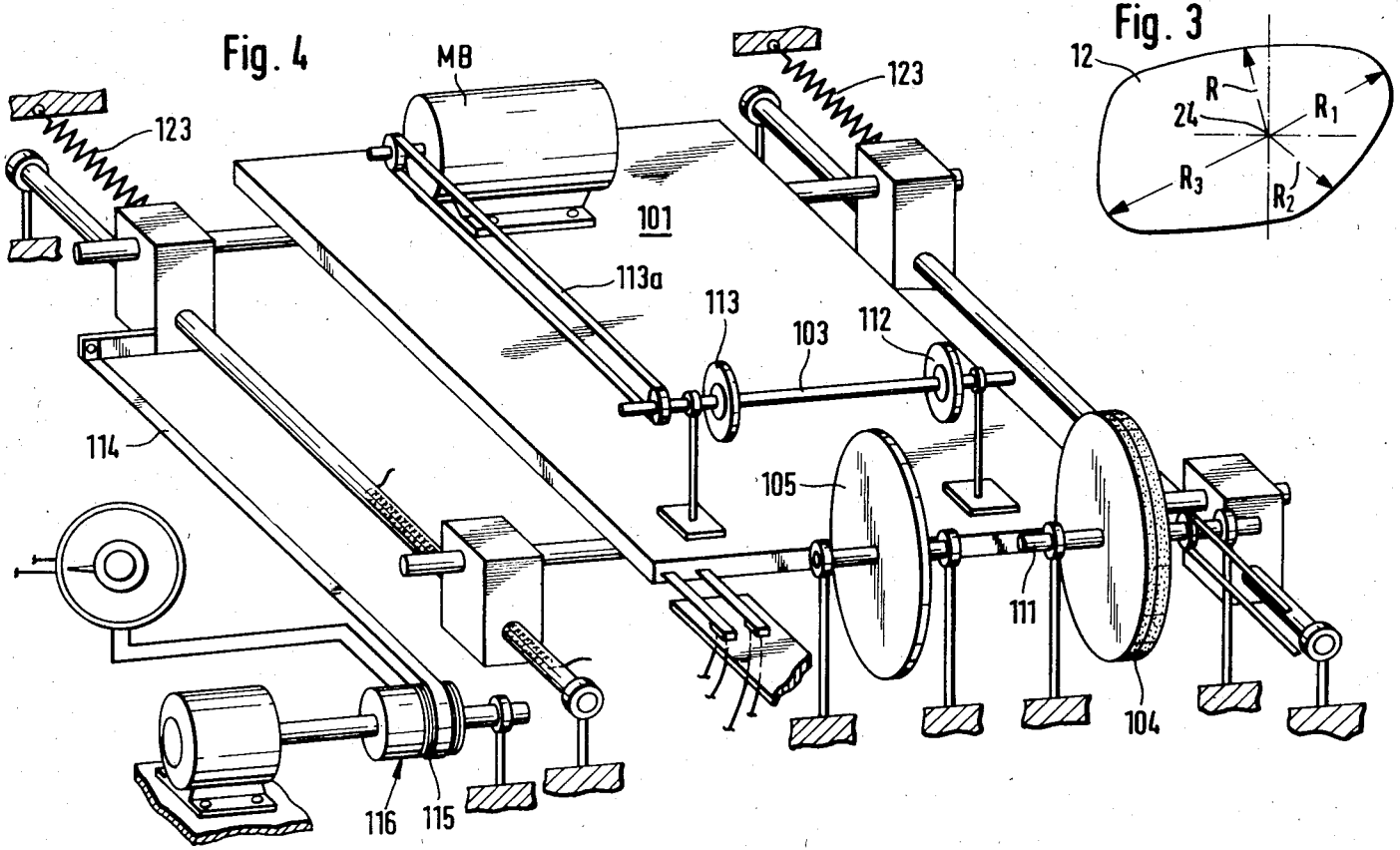
Figure 5:
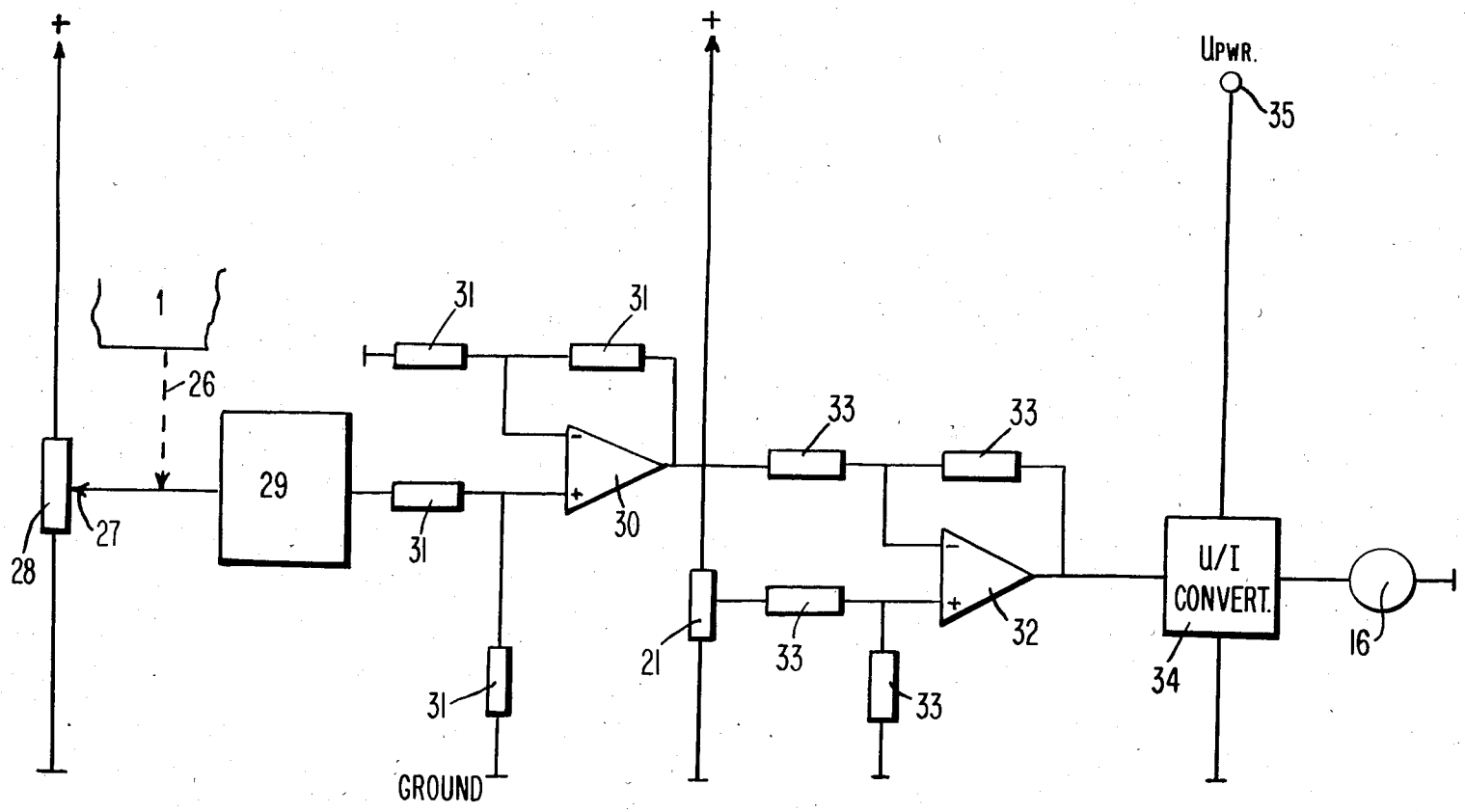

FIGS. *2a* and *2b* respectives show a corrective lens (with FIG. *2a* showing a positive-correction lens and FIG. *2b* showing a concave or negative-correction lens), with the aid of which the method of operation of the inventive machine is explained;

FIG. 3 shows a spectacle lens having greatly varying distances of its peripheral portions from the axis of rotation or machining;

FIG. 4 schematically illustrates another embodiment of the inventive spectacle lens edge grinding machine, with the spectacle lens and the template being arranged on the support, and the grinding wheel and the template abutment being fixedly mounted; and FIG. 5 is a circuit diagram for the embodiment of FIG. 1.

SUMMARY OF THE INVENTION

In conformity with the arrangement of the template abutment, the grinding wheel, and the support shaft for the spectacle lens and the template, the spectacle lens edge grinding machine of the present invention is characterized either in that, in the direction of movement of the support, a spring element which brings the support into its starting position acts on the support on that side remote from the support shaft for the spectacle lens and the template, and a tensioning device, which can be actuated and the tensioning force of which can be regulated, acts on the support on that side which faces the support shaft for the spectacle lens and the template; or in that, in the direction of movement of the support, a spring element, which brings the support into its starting position, acts on the support on that side remote from the template abutment and the grinding wheel, and a tensioning device, which can be actuated and the tensioning force of which can be regulated, acts on the support on that side which faces the template abutment and the grinding wheel.

Preferably the tensioning device, which can be actuated and the tensioning force of which can be regulated, is an electromagnetic clutch or coupling having a chain, a belt, a band, etc. which is mounted on a support arm of the support or on the support itself, and which can be wound on the reel of the clutch, or the length of which can be adjusted by means of this reel.

If the grinding machine has a linearly movable support, the latter is advantageously guided horizontally, and the chain, belt, band, etc. act on an intermediate support on which the support can be freely moved parallel to the support shafts for the grinding wheel and the spectacle lens.

If an electromagnetic clutch is used, the latter may be infinitely variable by means of a potentiometer Similarly, with a linear movement of the support or its intermediate support, this movement may be detected by a sensor or may be detected without contact, and the respectively determined value of movement of the intermediate support or of the support is transferred directly to the clutch, the potentiometer, or a computer. For this purpose, inductive or capacitive sensors can be mounted on the intermediate support or on the support for detecting the change in grinding pressure during the process of grinding the lenses or corrective lenses; these sensors effect the automatic adjustment of the clutch or the potentiometer.

The invention has the advantage that the grinding pressure can be adjusted in the ratio of 1:5, i.e. from, for example, 2 kg to 10 kg. By detecting the movement of the spectacle lens with the template, or the movement of the grinding wheel with the template abutment, and hence the distance of that peripheral portion of the spectacle lens which is being ground at any given time from the axis of rotation of the lens, the grinding pressure can conform or adapt to the respective cross sectional shape of the lens The present invention also has the advantage that when the voltage at the electromagnetic clutch falls off, an immediate resetting of the support, and hence a removal of the grinding wheel from the lens or the lens from the grinding wheel, occurs.

DESCRIPTION OF PREFERRED EMBODIMENTS

Referring now to the drawings in detail, in the inventive embodiment of the spectacle lens edge grinding machine illustrated in FIG. 1, the grinding wheel 4 and the template abutment 5 are adjustable, while the spectacle lens 12 and the template or pattern 13 are fixedly monted. The spectacle lens edge grinding machine of the present invention is provided with a carriage or support 1 which can be adjusted in two directions. The rear part 2 of the support 1 carries a drive motor MS for the grinding wheel 4, and the front part of the support 1 is provided with a grinding wheel shaft 3 which is driven by the aforementioned motor MS via the chain or belt 3*a*.The template abutment 5 is fixedly arranged on the support 1 parallel to and at a distance from the grinding wheel 4. The support 1 is furthermore provided with two transverse shafts 6, 7 which can be moved transversely in guide blocks 8, 8*a*, and hence parallel to the shaft 3, so that the support 1 can move in the direction of the double arrow K.

The guide blocks 8, 8*a* are mounted in pairs on two guide rods which are parallel to one another and which are fixedly connected with the machine frame at 10 As a result, the support 1 can move in the direction of the double arrow S; this is the movement of the support 1 which affects the grinding pressure.

The shaft 11 for supporting the spectacle lens 12 and the template or pattern 13 is arranged in front of the support 1 on the machine frame. The shaft 11 is turned by a non-illustrated motor via the chain or belt 12*a*. Mounted in a known way on the shaft 11 are the spectacle lens 12 which is to be ground, and the template 13. The part of the shaft 11 which supports the lens 12 is divided into two shaft halves, with one half being adjustable relative to the other half so that the lens can be clamped between the two shaft halves, as is known in the art.

An inelastic yet flexible tensioning member 14 acts on the side of one of the rear guide blocks 8*a*, and in the illustrated embodiment, on the left guide block 8*a*. The tensioning member 14 is parallel to the guide rods 9, and its front end, which is approximately at the level of the shaft 11, is wound about the reel part of a magnetic clutch or coupling 16, the drive part 17 of which is driven by a motor 19 via a shaft 18. The winding part of the clutch 16 is connected by means of an electrical line 20 with a potentiometer 21, with the aid of which the voltage of the coil part of the clutch 16 can be adjusted. In this way the tension of the member 14 can be regulated.

Springs 22, which are disposed in the direction of the member 14 and of the two parallel guide rods 9, act on the two rear guide blocks 8*a*; these springs 22 endeavor to pull the support 1 against the support 23 which is fixed to the machine. The springs 22 initially hold the support 1 in the position illustrated in FIG. 1 in which the grinding wheel 4 and the template abutment 4 are spaced from the fixedly mounted lens 12 and template 13. If the clutch 16 is actuated, the reel part 15 thereof, in conformity with the appropriate voltage, pulls the support 1 in such a way that the grinding wheel 4 and the template abutment 5 rest against the lens 12 and the template 13. The tension of the member 14 can be varied over a wide range.

FIG. 2*a* shows a positive-correction lens 12*a*, and FIG. 2*b* shows a concave or negative-correction lens 12*b*. As can be seen from these figures, the peripheries of the spectacle lens blanks respectively have a thickness "m" and "n", and when the positive lens of FIG. 2*a* is ground in the direction of arrow L, the portion which is to be ground increases in thickness, while when the concave lens of FIG. 2*b* is ground in the direction of the arrow L, the thickness of the lens decreases from the periphery toward the center.

FIG. 3 shows the periphery of a modern spectacle lens 12, the distances R, $R_1$, Rhd 2, and $R_3$ of which from the central point of rotation or machining 24 of the lens vary greatly. In conformity therewith, and in connection with the embodiments of FIGS. 2*a* and 2*b*, it can be seen, for example, with the positive-correction lens of FIG. 2*a*, that at the radius R the lens is thicker than at $R_1$, and that at $R_3$, the lens is thinner than at $R_2$. If the spectacle lens of FIG. 3 is a concave lens, as shown for example in FIG. 2*b*, the relationships between the radii are reversed. From the foregoing it can be seen that the economical and time-saving grinding of modern spectacle lenses entails a varying grinding pressure over the periphery of the lens. In order to take this into consideration, the support 1 is provided with a preferably non-contact sensor which detects the distances R–$R_3$ at the periphery of the lens and directly or indirectly transmits the results thereof to the clutch 16, which, in conformity with the distances of the grinding wheel 4 from the central point of rotation 24 (FIG. 3), and hence of the magnitudes R–$R_3$, is varyingly actuated.

The support or sliding carriage 1 shifts in the course of a grinding procedure under effect of force exerted by the motor 19 in a direction upon the spectacle lens 12. The path of work traversed by the support or carriage 1 and the grinding disc or template 13 during the grinding procedure is transferred via a tie rod or connecting rod 26 onto a sliding contact or wiper 27 of a potentiometer 28.

The potentiometer 28 is shown also in the circuit of FIG. 5. The coupling or connecting rod 26 (symbolically represented by dashlines), which moves the sliding contact or wiper 27, at an end thereof, is provided with an arrow, that represents the working or operating direction. A constant direct voltage is applied to the ends of the potentiometer 28. Accordingly, there results that the voltage obtained respectively from the potentiometer 28 decreases with decreasing spectacle lens diameter and accordingly is a measurement or gauge for the deflection movement of the support or carriage, respectively, for the reduction of the spacing or distance to the spectacle lens center or mid-point.

The direct voltage obtained respectively from the sliding contact or wiper 27 is applied to an adjustment or setting device 29 with the aid of which the voltage can be varied by manual setting or adjustment in such a manner that the diameter, upon which there lies the spectacle lens surface respectively to be ground, and the cross-sectional course or path of the respective type of spectacle lens are taken into consideration in an appropriate manner as seen from the outside to the inside.

An amplifier 30 is connected after the adjustment or setting device 29 With the aid of four resistances 31 arranged in the illustrated manner, there can be prescribed or specified the characteristic property or characteristic curve of the amplifier 30 (degree of amplification), which in the present situation is proportional. A differential or an integral characteristic property or curve also is attainable, if necessary, with other circuits.

The circuit illustrated in FIG. 5 also shows the already mentioned potentiometer 21, with the aid of which there can be prescribed a starting value for the grinding pressure. A voltage corresponding to this starting value as well as the voltage coming from the amplifier 30 are supplied to a combined or master amplifier 32. The characteristic property or curve of the master amplifier 32 is given or prescribeable with resistances 33 in a manner similar to that with the amplifier 30.

The initial or starting voltage delivered by the master amplifier 32 is applied upon a transformer or converter 34 for current flowing in the potential circuit via which converter there is controlled the already mentioned slip clutch or coupling 16. The converter 34 for current flowing in the potential circuit has a supply voltage applied thereto via connection terminals 35; this supply voltage assures and guarantees performance of slip clutch or coupling 16.

Accordingly, the circuitry of FIG. 5 as a whole represents an automatic control system with which a grinding pressure at an optimum respectively for the grinding can be advanced.

In the inventive embodiment illustrated in FIG. 1, the grinding wheel 4 and the template abutment 5 are mounted on the movable support or carriage 1. The opposite is true with the inventive embodiment illustrated in FIG. 4. Here, the spectacle lens 112 with the template or pattern 13 on the shaft 103 can be adjusted on the horizontally movable carriage or support 101, while the grinding wheel 104 and the template abutment 105 are arranged on the shaft 111, i.e. are fixedly mounted to the machine frame. With both embodiments, with the aid of the tensioning member 14 or 114, reel part 15 or 115 and by means of the clutch 16 or 116, a grinding pressure can be applied which can be varied over a wide range. When the voltage is removed from the clutch 16 or 116, an abrupt resetting of the support 101 to its starting position is effected with the aid of the springs 123, so that removal of the spectacle lenses from the grinding wheel can be momentarily effected.

The present invention is, of course, in no way restricted to the specific disclosure of the specification and drawings, but also emcompasses any modifications within the scope of the appended claims.

What we claim is:

1. A spectacle lens edge grinding machine, comprising:

a machine frame;

a support mounted on and movable relative to said machine frame;

a grinding wheel mounted on said support;

a template abutment mounted on said support;

a support shaft for a spectecle lens and a template, said support shaft being fixedly mounted on said machine frame; with said support being movable toward and away from said support shaft;

a spring arrangement operatively associated with said machine frame and said support for bringing the latter into a starting position; said spring arrangement, when viewed in the direction of movement of said support toward said support shaft, acting on that side of said support which is remote from said support shaft; and a tensioning device operatively associated with said machine frame and said support for effecting movement of the latter toward said support shaft; said tensioning device, when viewed in the direction of movement of said support toward said support shaft, acting on that side of said support which faces said support shaft; said tensioning device being actuatable, and the tensioning force thereof being regulatable to go beyond variation of pressure of engagement of the lens before beginning of grinding procedure to vary the pressure during such grinding procedure dependent upon the shape and the resulting edge thickness of the lens being ground in such grinding procedure, such variation of pressure engagement of tbe lens including less grinding pressure of engagement when grinding a thinner edge portion of the lens edge and greater grinding pressure when grinding a thicker edge portion of the lens.

2. A grinding machine according to claim 1, in which said tensioning device includes an electromagnetic clutch with a reel, and a tensioning member which is operatively associated with said support and said reel; with the length of said tensioning member being adjustable by means of said reel for effecting said regulation of the tensioning force of said tensioning device.

3. A grinding machine according to claim 2, in which said support is linearly movable and is guided horizontally; which includes intermediate supports which are mounted on and movable relative to said machine frame, and on which said support is freely movable parallel to said support shaft; and in which said tensioning member acts on one of said intermediate supports.

4. A grinding machine according to claim 3, in which said tensioning device includes a potentiometer for controlling said electromagnetic clutch.

5. A grinding machine according to claim 4, which includes means for detecting the movement of one of said support and said intermediate supports, and for transmitting the value thereof to said tensioning device.

6. A grinding machine according to claim 5, which includes a sensor operatively associated with one of said support and said intermediate supports for detecting changes in grinding pressure during grinding of the lens, said sensor being further associated with said tensioning device in such a way as to effect automatic adjustment thereof in response to detected changes in said grinding pressure.

7. A spectacle lens edge grinding machine, comprising:

a machine frame;

a support mounted on and movable relative to said machine frame;

a grinding wheel fixedly mounted on said machine frame;

a template abutment fixedly mounted on said machine frame;

a support shaft for a spectacle lens and a template, said support shaft being fixedly mounted on said support; with said support being movable toward and away from said grinding wheel and said template abutment;

a spring arrangement operatively associated with said machine frame and said support for bringing the latter into a starting position; said spring arrangement, when viewed in the direction of movement of said support toward said grinding wheel and said template abutment, acting on that side of said support which is remote from said grinding wheel and said template abutment; and a tensioning device operatively associated with said machine frame and said support for effecting movement of the latter toward said grinding wheel and said template abutment said tensioning device, when viewed in the direction of movement of said support toward said grinding wheel and said template abutment, acting on that side of said support which faces said grinding wheel and said template abutment; said tensioning device being actuatable, and the tensioning force thereof being regulatable to go beyond variation of pressure of engagement of the lens before beginning of grinding procedure to vary the pressure during such grinding procedure dependent upon the shape and the resulting edge thickness of the lens being ground in such grinding procedure, such variation of pressure of engagement of the lens including less grinding pressure of engagement when grinding a thinner edge portion of the lens edge and greater grinding pressure when grinding a thicker edge portion of the lens

8. A grinding machine according to claim 7, in which said tensioning device includes an electromagnetic clutch with a reel, and a tensioning member which is operatively associated with said support and said reel; with the length of said tensioning member being adjustable by means of said reel for effecting said regulation of the tensioning force of said tensioning device.

9. A grinding machine according to claim 8, in which said support is linearly movable and is guided horizontally; which includes intermediate supports which are mounted on and movable relative to said machine frame, and on which said support is freely movable parallel to said support shaft; and in which said tensioning member acts on one of said intermediate supports.

10. A grinding machine according to claim 9, in which said tensioning device includes a potentiometer for controlling said electromagnetic clutch.

11. A grinding machine according to claim 10, which includes means for detecting the movement of one of said support and said intermediate supports, and for transmitting the value thereof to said tensioning device.

12. A grinding machine according to claim 11, which includes a sensor associated with one of said support and said intermediate supports for dectecting changes in grinding pressure during grinding of the lens, said sensor being further associated with said tensioning device in such a way as to effect automatic adjustment thereof in response to detected changes in said grinding pressure.

13. A grinding machine according to claim 1, including control system circuitry having potentiometer means for obtaining voltage therefrom that decreases with decreasing spectacle lens diameter and accordingly applied to a setting device as a measurement for deflection movement of said support for reduction of spacing to the spectacle lens mid-point, said control system being determinative of grinding pressure value at an optimum for grinding advance.

14. A grinding machine according to claim 7, including control system circuitry having potentiometer means for obtaining voltage therefrom that decreases with decreasing spectacle lens diameter and accordingly applied to a setting device as a measurement for deflection movement of said support for reduction of spacing to the spectacle lens midpoint, said control system being determinative of grinding pressure value at an optimum for grinding advance.

* * * * *